United States Patent [19]

Gutridge et al.

[11] 4,138,949

[45] Feb. 13, 1979

[54] SLEEPING COMPARTMENT UPPER BERTH

[75] Inventors: Jack E. Gutridge, Dyer; Keith J. Hallam, Merrillville, both of Ind.

[73] Assignee: Pullman Incorporated, Chicago, Ill.

[21] Appl. No.: 850,881

[22] Filed: Nov. 14, 1977

Related U.S. Application Data

[63] Continuation of Ser. No. 669,927, Mar. 24, 1976, abandoned.

[51] Int. Cl.[2] ..... B61D 1/02; A47C 17/38

[52] U.S. Cl. ..... 105/315; 5/9 R; 105/314; 105/316; 105/321

[58] Field of Search ..... 105/314, 315, 316, 317, 105/321, 401, 409, 411; 296/65 R, 69, 28 F, 28 J, 28 K, 30; 5/9 R, 9 B; 52/625, 629

[56] References Cited

U.S. PATENT DOCUMENTS

| | | | |
|---|---|---|---|
| 444,741 | 1/1891 | Brandenburg | 105/315 |
| 928,985 | 7/1909 | Koch | 105/401 |
| 2,316,710 | 4/1943 | Parke | 105/315 |
| 2,514,032 | 7/1950 | Dean et al. | 105/315 X |
| 2,596,465 | 5/1952 | Booth | 52/629 X |
| 2,783,717 | 3/1957 | Meldrum | 105/317 |
| 3,672,309 | 6/1972 | VanDerSluys et al. | 105/401 |

*Primary Examiner*—Francis S. Husar
*Assistant Examiner*—Randolph A. Reese
*Attorney, Agent, or Firm*—Thomas G. Anderson

[57] ABSTRACT

A sleeping berth movable between stored and use positions includes an elongated pan having a central substantially deep portion and at opposite ends substantially narrower portions which contain a suitably shaped mattress. The shallow portions in the use position of the bed increase the head room for passengers seated on the compartment seats. The pan or shell of the berth also includes at one side thereof a tubular beam construction which houses a linkage mechanism for releasably locking the berth in use and non-use positions.

9 Claims, 8 Drawing Figures

SLEEPING COMPARTMENT UPPER BERTH

This is a continuation of application Ser. No. 669,927, filed Mar. 24, 1976, now abandoned.

BACKGROUND OF THE INVENTION

1. Field of the Invention

The field of invention broadly relates to sleeping cars and more specifically to an upper berth construction movable between stored and used positions.

2. Description of the Prior Art

The prior art is replete with patents pertaining to upper berths including various devices for locking and unlocking them between stored and used positions. Most of these mechanisms are of very complex nature and the present invention provides an improved and simplified construction. Also the berth pans of the prior art have been conventional and of a constant depth construction in many instances making it impossible for the average height person to be seated on the car seats when the bed is in a horizontal use position. The present invention overcomes the disadvantages of some of the prior art constructions.

SUMMARY OF THE INVENTION

In the present construction, a sleeping berth comprises a hollow pan having a central deep portion and at opposite ends thereof relatively shallower portions. In use the berth includes a mattress which is shaped in the same manner to fit the difference in depth portions with the shallower portions permitting the berth to be placed in a use position and still providing sufficient head room for the passenger seated on the passenger seats of the compartment. The pan construction also includes an elongated strengthened beam of hollow shape which provides a strong structure and which also provides a housing for a linkage arrangement which is utilized to latch and unlatch the berth from use or stored positions. The berth is hingedly connected to the outer side of the car and includes a hinge arrangement suitably counterbalanced by springs so that the berth may be easily lowered and raised as desired.

DESCRIPTION OF THE PREFERRED EMBODIMENT

Figure 2:
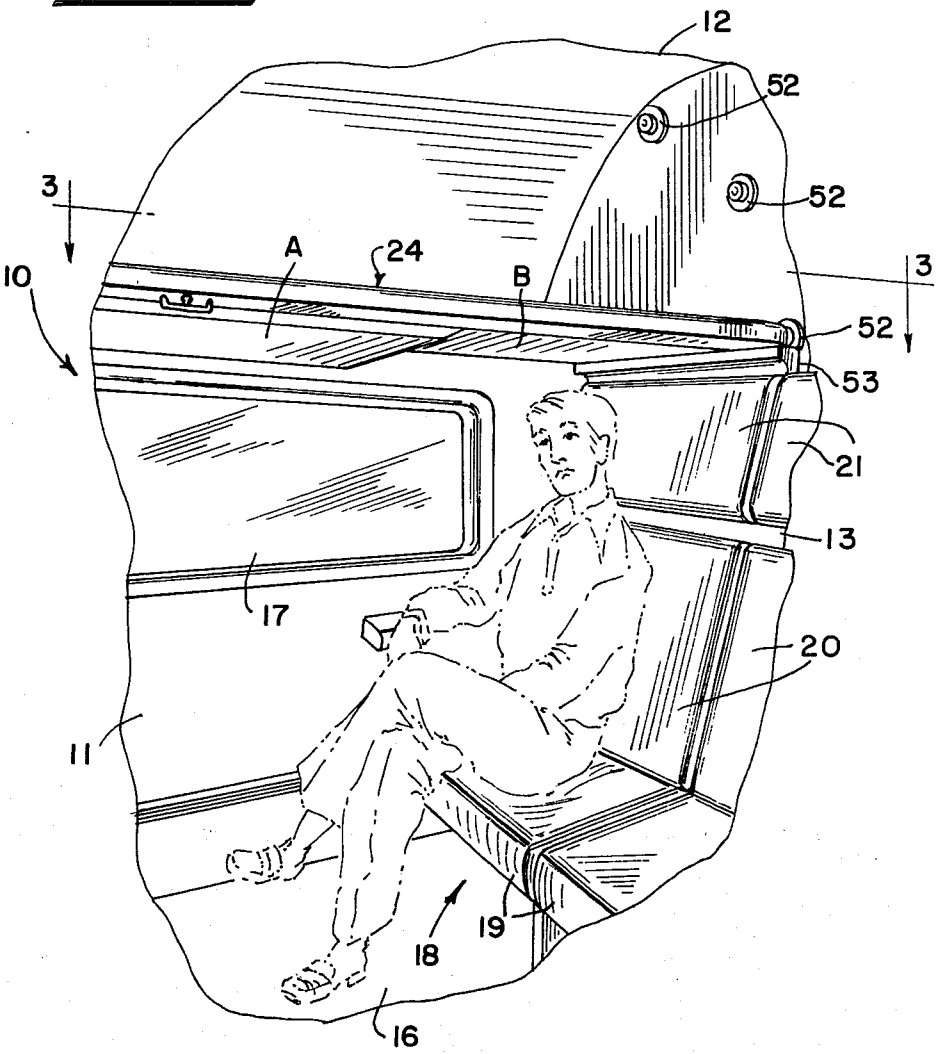
FIG. 2 is a similar view showing a passenger seated within the compartment beneath a berth which has been placed in a use position.
Figure 1:
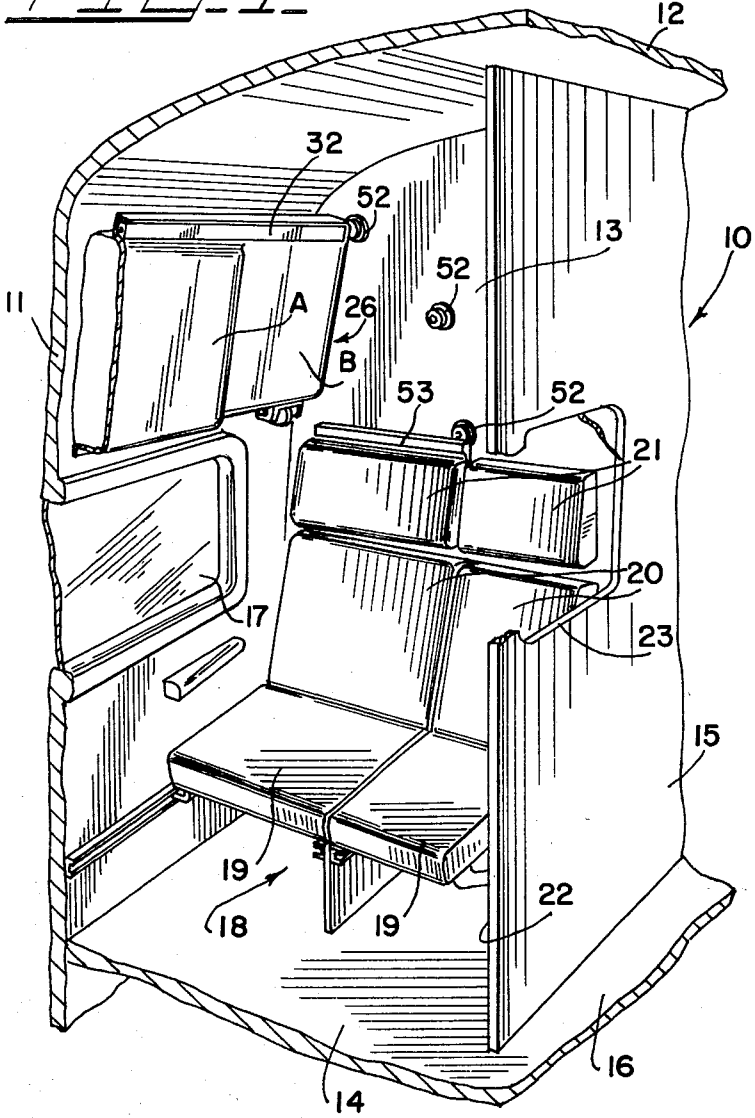
FIG. 1 is a perspective view of one half of a passenger compartment showing a seating and upper berth arrangement.
Figure 3:
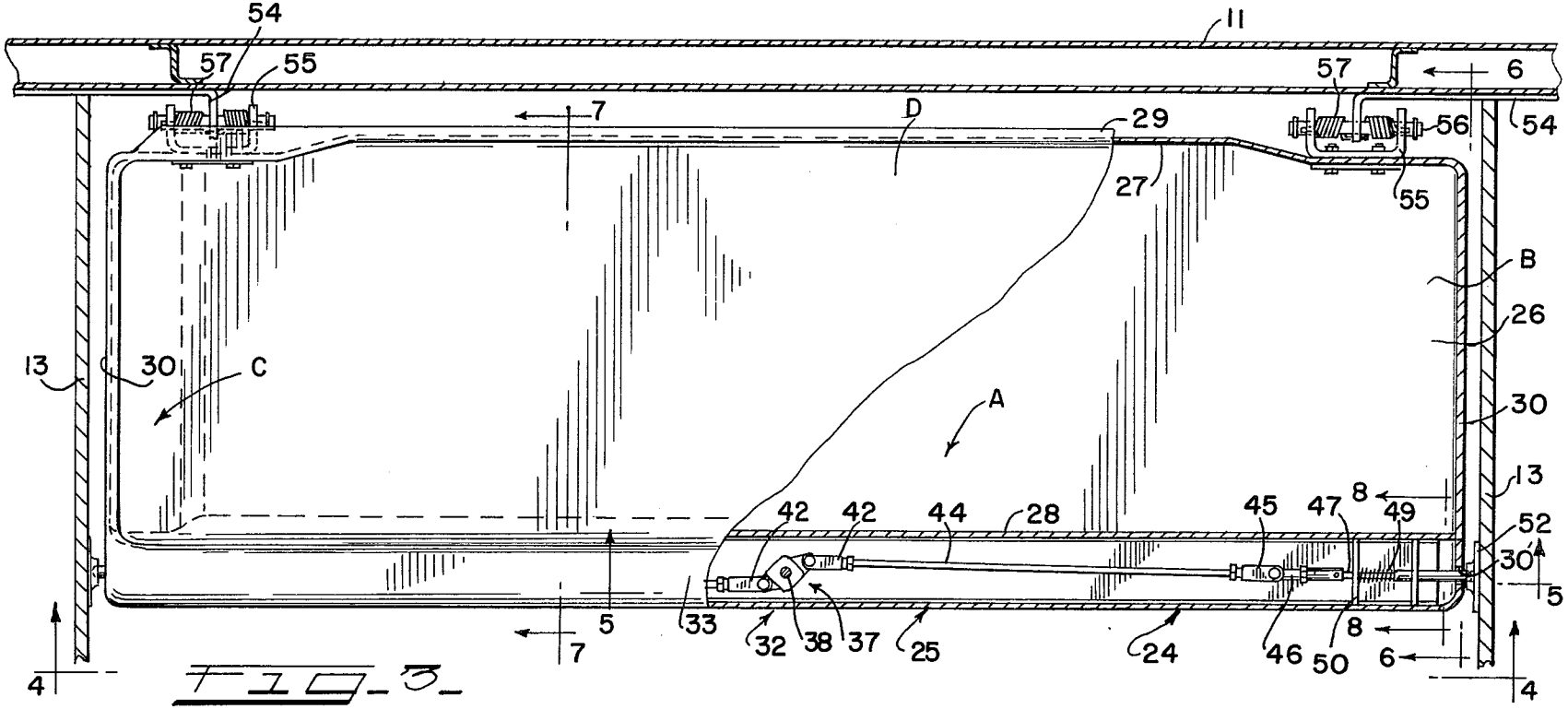
FIG. 3 is a plan view taken substantially along the line 3—3 of FIG. 2 with portions broken away to show the interior of a berth pan construction.
Figure 4:
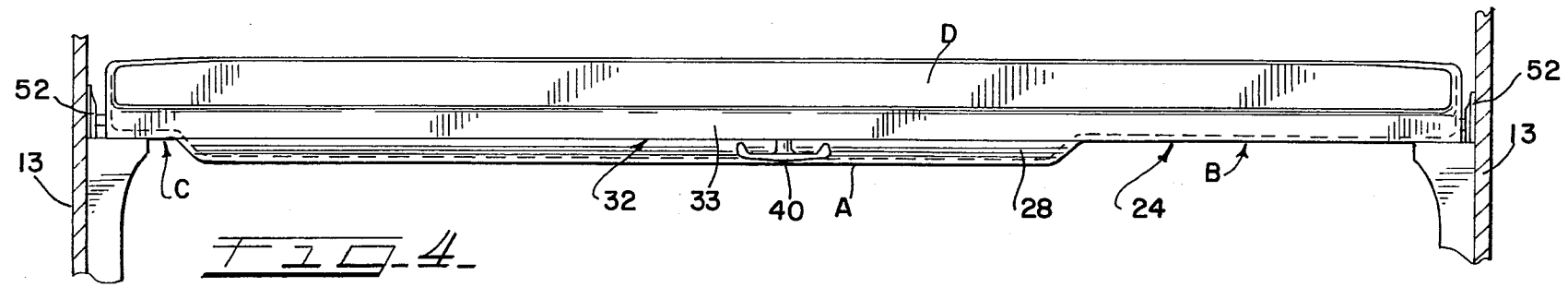
FIG. 4 is a side elevational view taken along the line 4—4 of FIG. 3.
Figure 5:
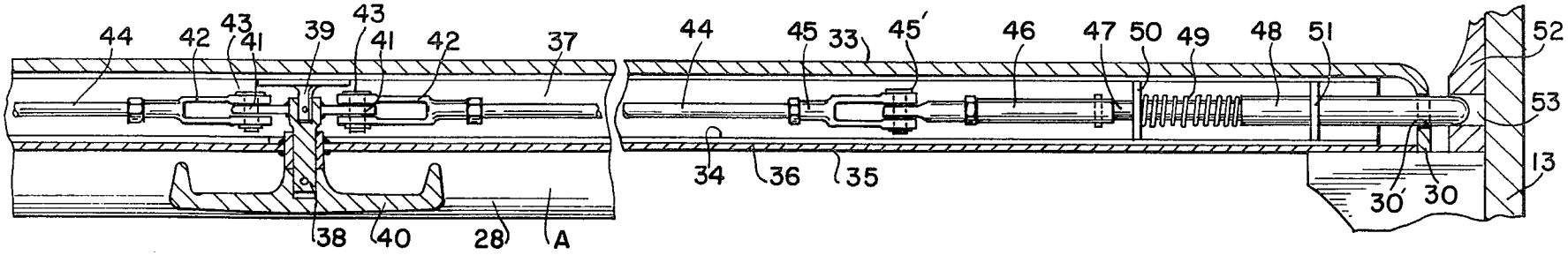
FIG. 5 is a cross-sectional view taken along the line 5—5 of FIG. 3.

FIGS. 1 and 2 disclose a railway passenger car portion 10 including an outer side wall 11 connected to a roof 12. Partition walls 13 extend laterally inwardly from the side wall 11 and are supported on a car floor 14. A longitudinally extending divider wall 15 suitably connected to the partition wall 13 provides a passenger compartment. The divider walls 15 conventional in railway compartmented cars provide an aisle 16. The outer wall includes a window 17 and the compartment is provided with a convertible seat arrangement 18 comprising a pair of seats 19, longitudinally spaced, each seat being positioned adjacent one of the partition walls. The convertible seat arrangement 18 may be readily converted to a lower sleeping berth arrangement. The arrangement 18 also includes seat backs 20 positioned beneath head rests 21. The compartment is accessible through a door opening 22 provided in the divider wall 15. The divider wall also includes at least one inner window 23.

Figure 6:
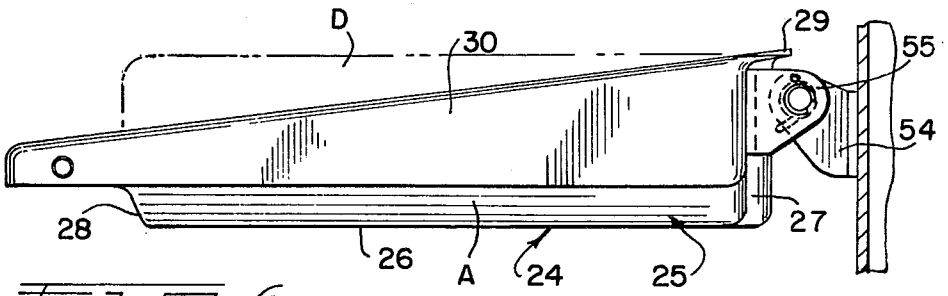
FIG. 6 is a cross-sectional view taken substantially along the line 6—6 of FIG. 3.
Figure 7:
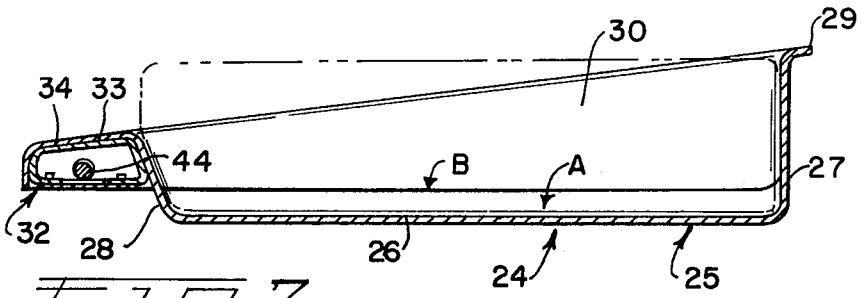
FIG. 7 is a cross-sectional view taken substantially along the line 7—7 of FIG. 3.
Figure 8:
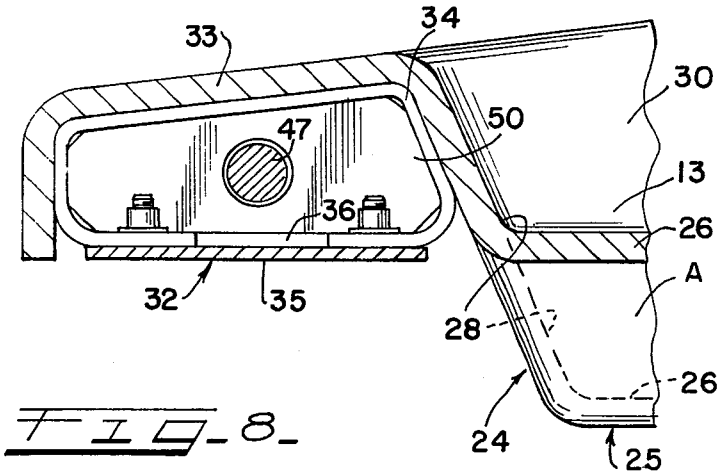
FIG. 8 is a cross-sectional view taken along the line 8—8 of FIG. 3.

An upper berth is generally designated at 24 and comprises a berth shell or pan 25 having a bottom wall 26 and upright side walls 27 and 28. The side walls 27 as best shown in FIGS. 6 and 7 are also provided with an upper outwardly extending flange 29. The pan 25 also includes end walls 30 provided with openings 30'. The pan has a central relatively deep portion which is designated at A and is provided at opposite ends thereof with shallower portions B and C. A mattress is designated at D and the mattress is shaped so as to complement or conform to the relative deeper portion A and the shallower portions B and C. The inner side wall 28 supports a beam generally designated at 32 the same extending substantially the length of the pan or shell 25. The beam is provided by an outward and downwardly extending flange 33 as best shown in FIG. 8 and is integral with the side wall 28. The beam 32 supports an elongated tube of rectangular shape generally designated at 34 the same being firmly secured within the shaped beam flange 33. An access plate 35 extends substantially the length of the tube 34 of the said tube being provided with an elongated slot 36. The access plate 35 is removable to provide access through the slot 36 for adjusting a locking mechanism generally designated at 37 which is supported within the said tube 34. The locking mechanism 37 includes a shaft 38 which is rotatably mounted on a pivot bracket 39 firmly secured to the tube 34. The shaft 38 also projects outwardly through the tube 34 and has connected thereto a handle or actuator 40. A pair of ears 41 are connected to the shaft 38 to rotate therewith.

The locking and latching mechanism includes an adjustable linkage arrangement having clevises 42 rotatably connected to the ears 41 by means of pivot pins 43. The clevises 42 in turn are connected to linkage members or rods 44 in turn connected to clevises 45. The clevises 45 are hingedly connected by means of hinge pins 45' in turn connected to tubular links 46, in turn rigidly connected to rods 47. The rods 47 have connected thereto lock plungers 48 which are normally urged outwardly by means of coil springs 49 supported on the rods 47 and placed in tension by means of stops 50 rigidly provided within the tube 34. The lock plungers project through the openings 30' and are guided by means of guides 51 also supported within the tube. A number of receptacles 52 as best shown in FIGS. 1 and 2 are supported on the side walls 13. The receptacles are vertically spaced, the upper and lower of the receptacles providing support means when the berth is in stored or use position. The intermediate receptacle 52 is provided as a safety feature in the event the berth inadvertently drops downwardly from a stored position it will be retained against further descent by means of the intermediate receptacle. Furthermore, in moving the berth upwardly it will initially catch in the intermediate receptacle and thus the passenger can be assured that the berth can be safely stored in the stored position and that there are no other objects in the berth which might become damaged or injured.

In the lowered position the opposite ends of the pan and berth are supported on the top head rest brackets 53 thus providing a firm support and utilizing the head rest brackets for this purpose.

The berth is hingedly connected to the outer side wall 11 by means of hinge brackets 54 and 55. The hinge brackets are interconnected by means of a hinge pin 56 suitably connected to a torsion spring 57 which is also suitably anchored on brackets so that the torsion spring 57 will balance the berth in a manner that can easily be moved to a stored position and also can easily be hinged downwardly to a sleeping position by the passenger.

OPERATION

As shown in FIG. 1 the stored position of the berth is accomplished when the plungers 48 of the latching and locking mechanism are in engagement with the uppermost of the receptacles 52. The operator by turning the handle 40 causes the push pull rods or linkages to move out of engagement with the receptacles whereupon the bed may now easily be lowered to the use or sleeping position. The counterbalance hinge arrangement permits the passenger to easily move the bed downwardly until it is supported on the head rest 53 provided at the opposite ends of the compartment. In this position the lowermost of the receptacles 52 is now engaged by the lock plungers 48 so that the bed is firmly locked in position. To return the berth to its stored position the operation is reversed. The intermediate receptacle 52 serves as a safety feature to prevent inadvertant lowering of the bed in the event for some reason the bed would become released from the upper receptacle. Also the intermediate receptacle prevents the sudden closing of the bed by the passenger which could be undesirable if a child or some object would be still resting on the top of the berth. As best shown in FIG. 2 the shallow section provides for sufficient head room for a passenger seated in the compartment while the bed is in use position.

The relatively deep portion of the pan or shell allows a thicker section of mattress which supports the heaviest part of the passenger's body. This is not required to any great extent at the opposite ends where the shallower portions accommodate the head room of the passengers. The release handle is also located in the deepened portion and thus does not protrude outwardly from the berth in a manner which might injure the passenger. The inner edge of the shell also is provided with the beam or channel section which is built into the basic structure of the pan. This beam provides the strength for the berth lengthwise and thus accommodates the bending loads. It also houses the locking mechanism and provides a hand hold for passengers getting into and out of bed. Conventional safety webbing which is utilized in upper berths also can be connected to the beam without sacrificing any of the bed space of the berth. By means of the counterbalance provided by the double torsion springs the bed can be raised or lowered with a mininum of effort.

The foregoing description and drawings merely explain and illustrate the invention and the invention is not limited thereto, except insofar as the appendant claims are so limited, as those skilled in the art who have the disclosure before them will be able to make modifications and variations therein without departing from the scope of the invention.

What is claimed is:

1. A railway passenger car including a compartment having an outer car side wall, a pair of laterally extending longitudinally spaced partition walls, a divider wall arrangement connected to said partition wall, said divider wall arrangement extending longitudinally and including an opening into said compartment, laterally extending seats positioned adjacent said partition walls and longitudinally spaced relative to each other, the improvement comprising;

an upper berth including, a shell-like berth pan structure, means hingedly connecting said pan structure to said side wall for movement from a stored position against said wall to a horizontal use position, said pan having a central relatively deep dished portion and relatively shallow dished portions at longitudinally opposite ends of said pan and including a generally vertical wall having a flat upper edge portion about the periphery thereof, at least one of said shallow portions in the use position of said berth being disposed directly above said respective seat for providing increased head room for passengers seated on said seat, headrests secured to said partition walls above said seats, said headrests supporting opposite ends of said pan in said use position, and means on said pan releasably locking said pan in the use and stored position on said partition walls.

2. The invention in accordance with claim 1, said releasable locking means including a push pull linkage arrangement having a rotatable manual locking actuator, said arrangement including a pair of locking rods rotatably connected to said actuator and projecting outwardly from opposite ends of said pan, and a pair of first locking receptacles positioned in vertically spaced relation on each of said partitions, said rods being engageable with said receptacles for releasably locking said berth in said use or stored positions.

3. The invention in accordance with claim 2, including a second locking receptacle on each of said partition walls positioned vertically between said first receptacles.

4. The invention in accordance with claim 2, said pan having an outer hollow beam portion extending longitudinally along an inner side of said pan, said releasable locking means being supported within said hollow beam portion.

5. The invention in accordance with claim 4, said hollow beam portion including an outwardly and downwardly directed flange on said pan, and a longitudinally extending tubular member supported by said flange.

6. A railway passenger car including a compartment having an outer car side wall, a pair of laterally extending longitudinally spaced partition walls, a divider wall arrangement connected to said partition wall, said divider wall arrangement extending longitudinally and including an opening into said compartment, laterally extending seats positioned adjacent said partition walls and longitudinally spaced relative to each other, the improvement comprising;

an upper berth including, a berth pan structure, means hingedly connecting said pan structure to said side wall for movement from a stored position against said wall to a horizontal use position, said pan having a central relatively deep portion, and relatively shallow portion at longitudinal opposite ends of said pan, said shallow portions in the use position of said berth providing increased head room for passengers seated on said seats, means on said partition walls supporting opposite ends of said pan in said use position, means on said pan releasably locking said pan in the use and stored position on said partition walls, said releasable locking means including a push pull linkage arrangement having a rotatable manual locking actuator, said arrangement including a pair of locking rods rotatably connected to said actuator and projecting outwardly from opposite ends of said pan, a pair of locking receptacles positioned in vertically spaced relation on each of said partitions, said rods being engageable with said receptacles for releasably locking said berth in said use or stored positions, said pan having an outer hollow beam portion extending longitudinally along an inner side of said pan, said releasable locking means being supported within said hollow beam portion, said hollow beam portion including an outwardly and downwardly directed flange on said pan, and a longitudinally extending tubular member supported by said flange, said deep portion of said pan projecting substantially below said beam portion, said locking actuator including a handle supported on said beam above the deepest portion of said pan.

7. A railway passenger car including a compartment having an outer car side wall, a pair of laterally extending longitudinally spaced partition walls, a divider wall arrangement connected to said partition wall, said divider wall arrangement extending longitudinally and including an opening into said compartment, laterally extending seats positioned adjacent said partition walls and longitudinally spaced relative to each other, the improvement comprising;

an upper berth including, a berth pan structure, means hingedly connecting said pan structure to said side wall for movement from a stored position against said wall to a horizontal use position, said pan having a central relatively deep portion, and relatively shallow portion at longitudinal opposite ends of said pan, said shallow portions in the use position of said berth providing increased head room for passengers seated on said seats, means on said partition walls supporting opposite ends of said pan in said use position, means on said pan releasably locking said pan in the use and stored position on said partition walls, said releasable locking means including a push pull linkage arrangement having a rotatable manual locking actuator, said arrangement including a pair of locking rods rotatably connected to said actuator and projecting outwardly from opposite ends of said pan, and a pair of locking receptacles positioned in vertically spaced relation on each of said partitions, said rods being engageable with said receptacles for releasably locking said berth in said use or stored positions, said pan having an outer hollow beam portion portion extending longitudinally along an inner side of said pan, said releasable locking means being supported within said hollow beam portion, and said beam portion being of channel shaped cross-section.

8. A railway passenger car including a compartment having an outer car side wall, a pair of laterally extending longitudinally spaced partition walls, a divider wall arrangement connected to said partition walls, said divider wall arrangement extending longitudinally and including an opening into said compartment, laterally extending seats positioned adjacent said partition walls and longitudinally spaced relative to each other, the improvement comprising;

an upper berth including, a shell-like berth pan structure, means hingedly connecting said pan structure to said side wall for movement from a stored position against said wall to a horizontal use position, said pan having a central relatively deep dished portion and at least one relatively shallower dished portion at an end of said pan and including a generally vertical wall having a flat upper edge portion about the periphery thereof, said at least one shallow portion in the use position of said berth providing increased headroom for passengers seated on said seats, headrests secured to said partition walls above said seats, said headrests supporting opposite ends of said pan in said use position, and means on said pan releasably locking said pan in the use and stored position on said partition walls.

9. An upper berth structure for a railway car compartment of the type having seats at each end thereof spaced lengthwise of the car, a berth pan having a major relatively deep central portion and relatively shallow end portions, said pan being adapted to be positioned horizontally for use above said seats with said shallow portions vertically aligned with respective seats while said seats are disposed in use position for providing head clearance for occupants of said seats, inner and outer relatively straight and vertical edge portions extending lengthwise of the car and vertical end wall portions extending therebetween, said end wall portions tapering inwardly from said outer edge portion to said inner edge portion, and said edge and end wall portions forming an upper peripheral wall for said pan.

* * * * *